US008925523B2

(12) United States Patent
Sahini et al.

(10) Patent No.: US 8,925,523 B2
(45) Date of Patent: Jan. 6, 2015

(54) VENTED PRESSURE RELIEF VALVE FOR AN INTERNAL COMBUSTION ENGINE FUEL SYSTEM

(75) Inventors: Deepak Sahini, Columbus, IN (US); W. Joseph Satterfield, Perth (AU); Robert P. Erickson, Columbus, IN (US); Jeffrey J. Sullivan, Columbus, IN (US); Donald J. Benson, Columbus, IN (US)

(73) Assignee: Cummins Intellectual Property, Inc., Minneapolis, MN (US)

( * ) Notice: Subject to any disclaimer, the term of this patent is extended or adjusted under 35 U.S.C. 154(b) by 150 days.

(21) Appl. No.: 13/548,697

(22) Filed: Jul. 13, 2012

(65) Prior Publication Data

US 2014/0014074 A1 Jan. 16, 2014

(51) Int. Cl.

| | |
|---|---|
| ***F02M 69/54*** | (2006.01) |
| ***F02M 59/46*** | (2006.01) |
| *F02M 37/04* | (2006.01) |

(52) U.S. Cl.

CPC ..... *F02M 59/46* (2013.01); *F02M 69/54* (2013.01); *F02M 37/04* (2013.01)

USPC ..... 123/463; 123/514

(58) Field of Classification Search

USPC ..... 123/506, 514, 457, 459, 461, 456, 463; 137/538, 479, 542, 543.13, 543.23, 137/516.27

See application file for complete search history.

(56) References Cited

U.S. PATENT DOCUMENTS

| | | | | |
|---|---|---|---|---|
| 3,778,029 | A | 12/1973 | Baker | |
| 5,386,809 | A | 2/1995 | Reedy et al. | |
| 6,116,272 | A | 9/2000 | Kratzet | |
| 6,125,822 | A * | 10/2000 | Janik et al. | 123/457 |
| 6,206,057 | B1 * | 3/2001 | Benjey et al. | 141/198 |
| 6,244,253 | B1 * | 6/2001 | Haeberer et al. | 123/514 |
| 6,446,613 | B1 * | 9/2002 | Djordjevic | 123/514 |
| 6,659,127 | B2 | 12/2003 | Keast | |
| 8,047,227 | B2 | 11/2011 | Buchberger et al. | |

* cited by examiner

*Primary Examiner* — Mahmoud Gimie
(74) *Attorney, Agent, or Firm* — Faegre Baker Daniels LLP

(57) ABSTRACT

A fuel pressure relief valve is positioned along a fuel circuit of an internal combustion engine. The pressure relief valve includes a valve body, a first plunger positioned within the valve body, a second plunger positioned within the first plunger, and a valve plug securing the first and second plungers in the valve body. A spring is positioned between the valve plug and the second plunger. Fuel leakage into the pressure relief valve causes the pressure relief valve to lift undesirably in the absence of excessive fuel pressure. The undesirable lifting undesirably affects the operation of the fuel rail and causes wear and shortened life of the pressure relief valve. The first plunger has at least one relief passage or groove located on an exterior surface, relieving the undesirable pressure buildup from a chamber formed between the valve body and the first plunger, eliminating undesirable liftoff events.

22 Claims, 4 Drawing Sheets

VENTED PRESSURE RELIEF VALVE FOR AN INTERNAL COMBUSTION ENGINE FUEL SYSTEM

TECHNICAL FIELD

This disclosure relates to fuel pressure relief valves for internal combustion engines. The pressure relief valves limit the maximum pressure, for example, in a fuel rail, to prevent damage to the engine, i.e., the fuel rail and fuel injectors fed by the fuel rail.

BACKGROUND

High-pressure fuel rails are used in conjunction with certain internal combustion engine designs, for example, diesel engines. Excessive pressure in these fuel rails can lead to problems with some of the components of a diesel engine. A fuel pressure relief valve is provided to relieve fuel pressure in a fuel rail that is above a predetermined level. Because of certain conditions associated with various engine components, fuel pressure relief valves can be subject to conditions that cause leakage into the pressure relief valve. For example, a plunger of the fuel pressure relief valve may move axially or laterally or can be subject to pressure pulsations that cause leakage into the pressure relief valve. Any leakage into the pressure relief valve is able to undesirably open the pressure relief valve. Such opening events may be frequent, leading to an undesired reduction in the fuel rail pressure and leading to wear of the pressure relief valve. The wear on the pressure relief valve can lead to improper performance and early failure of the relief valve. If the leakage that causes the pressure relief valve could be could be reduced or eliminated, pressure in the fuel rail would be maintained and the life of the pressure relief valve would be extended and performance throughout the life of the pressure relief valve may be improved.

SUMMARY

This disclosure provides an internal combustion engine comprising a fuel circuit, a fuel tank, a fuel pump, and a pressure relief valve. The fuel tank is positioned along the fuel circuit. The fuel pump is positioned along the fuel circuit downstream of the fuel tank. The pressure relief valve is in fluid communication with the fuel pump and the fuel tank. The fuel pressure relief valve includes a valve body, a valve body passage, a valve body cavity, a first plunger seat, a first plunger, a fuel chamber, a primary relief circuit, and an auxiliary relief circuit. The valve body passage is formed in the valve body. The first plunger seat is positioned in the valve body cavity adjacent the valve body passage. The first plunger is reciprocally mounted in the valve body cavity to form a sliding seal interface with the valve body. The fuel chamber is positioned in the valve body cavity between the first plunger and the valve body. The primary relief circuit is positioned to permit fuel flow from the fuel chamber. The auxiliary relief circuit is positioned fluidly in parallel to the primary relief circuit to permit fuel to flow from the fuel chamber toward the fuel tank when the pressure in the fuel chamber is below a predetermined pressure level. The auxiliary relief circuit includes a relief passage located along the sliding fluid seal interface. The first plunger includes a first plunger cavity. The first plunger is adapted to reciprocate between a closed position in abutment against the first plunger seat to block fuel flow through the valve body, and an open position a spaced distance from the first plunger seat, permitting flow through the valve body passage into the fuel chamber.

This disclosure also provides a pressure relief valve for an internal combustion engine. The internal combustion engine includes a fuel circuit, a fuel tank positioned along the fuel circuit, a fuel pump positioned along the fuel circuit downstream of the fuel tank, and a fuel rail positioned along the fuel circuit to receive fuel from the fuel pump. The pressure relief valve comprises a valve body, a first plunger, a primary relief circuit, and an auxiliary relief circuit. The first plunger is positioned in the valve body along a sliding interface to form a fuel chamber. The first plunger is positioned along the primary relief circuit. The auxiliary relief circuit is positioned fluidly in parallel to the primary relief circuit. The auxiliary relief circuit includes a relief passage located along the sliding interface to permit fuel to flow from the fuel chamber to the fuel tank when the pressure in the fuel chamber is below a predetermined pressure level. The primary relief circuit is positioned to permit fuel flow from the fuel chamber to the fuel tank when the pressure in the fuel chamber is above the predetermined pressure level.

Advantages and features of the embodiments of this disclosure will become more apparent from the following detailed description of exemplary embodiments when viewed in conjunction with the accompanying drawings.

DETAILED DESCRIPTION

Figure 1:
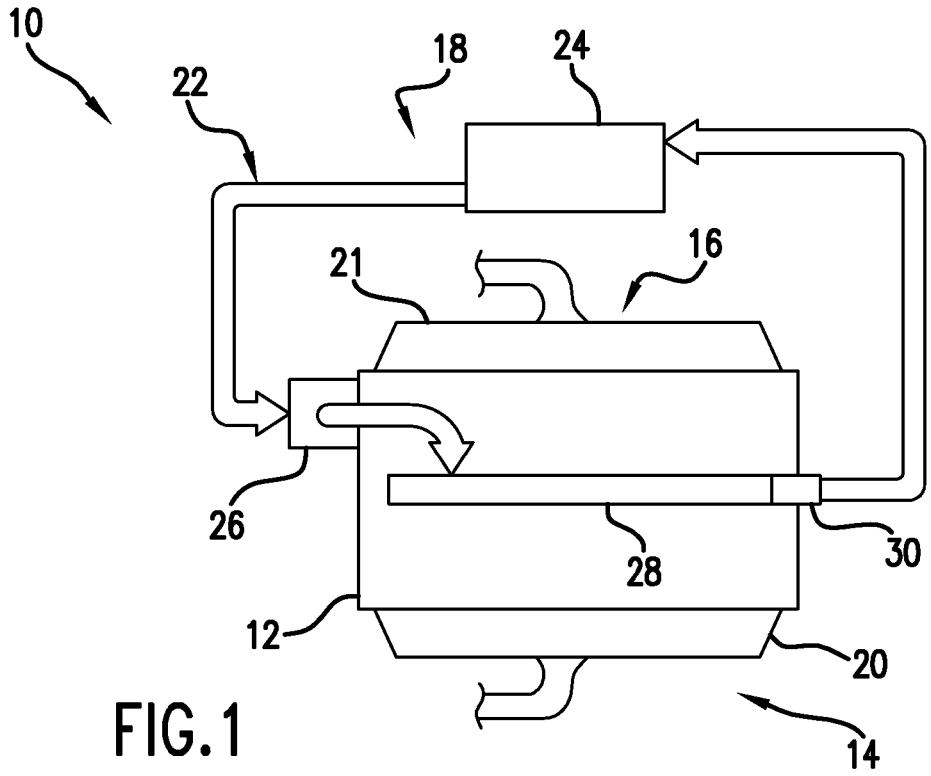
FIG. 1 is a simplified schematic of an internal combustion engine.
Figure 2:
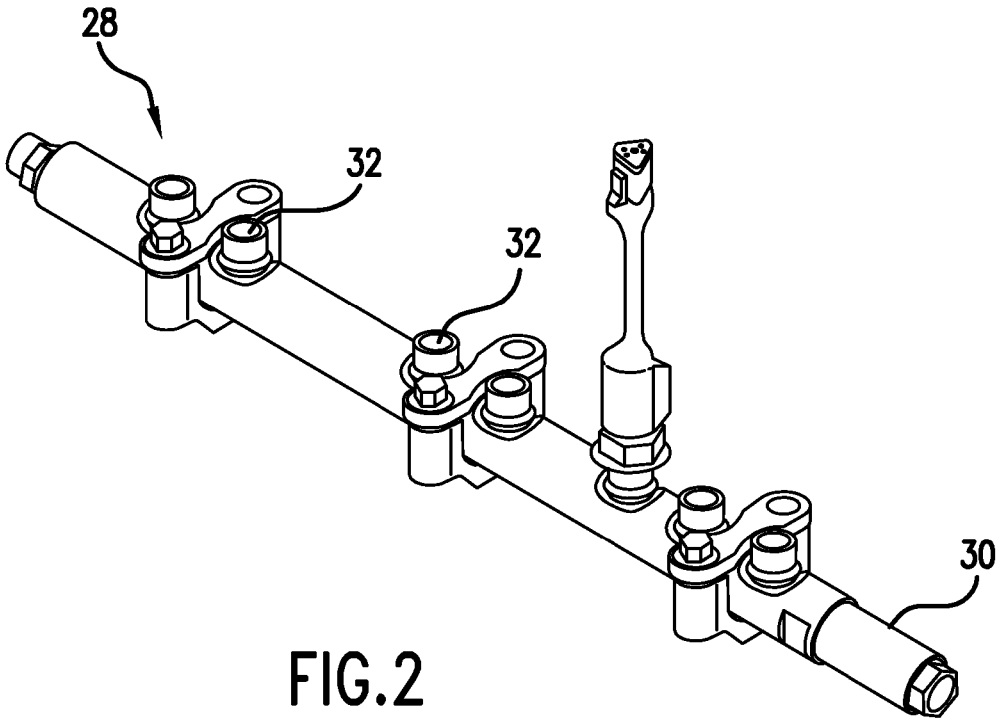
FIG. 2 is a fuel rail of the internal combustion engine of FIG. 1.

Referring to FIGS. 1 and 2, a portion of an internal combustion engine is shown as a simplified schematic and generally indicated at 10. Engine 10 includes an engine body 12, an intake system 14, an exhaust system 16, and a fueling system 18. Engine 10 may include other systems, such as a control system, an EGR system, and other systems supportive of the functions of engine 10. As will be described hereinbelow, fueling system 18 includes a pressure relief valve capable of relieving fuel leakage across a seat of the pressure relief valve. Such leakage may be caused by a variety of sources, for example, small axial or lateral movements of a valve plunger on its seat and/or resonant vibrations excited by, for example, engine revolutions per minute (RPM). By relieving or releasing this leakage, the fuel pressure relief valve is able to maintain the fuel pressure in, for example, a fuel rail, at a desirable level and the pressure relief valve is capable of achieving its rated performance over a longer life.

Intake system 14 includes an intake manifold 20 attached to engine body 12. Intake system 14 receives air from an air inlet (not shown). The air is then treated by components of intake system 14, such as filters (not shown). The air may mix with EGR gas and may then flow through a compressor of a turbocharger (not shown). The treated air then flows to intake manifold 20. From the intake manifold, the air flows into one or more combustion chambers (not shown). Fuel from fuel system 18 and air from intake system 14 ignite in the combustion chambers. Exhaust gas from the combustion chambers flows into an exhaust manifold 21 of exhaust system 16. The exhaust gas may flow through a turbine of a turbocharger to drive a compressor (not shown). A portion of the exhaust gas may flow through an EGR system (not shown). The exhaust gas may also flow through an aftertreatment system that includes one or more filters, catalysts, adsorbers, and other exhaust gas treatment devices.

Fuel system 18 includes a fuel circuit 22, a fuel reservoir or tank 24, a fuel pump 26, one or more fuel rails 28, and one or more pressure relief valves 30. Fuel pump 26 is positioned along fuel circuit 22 downstream from fuel reservoir or tank 24. One or more fuel rails 28 are positioned along fuel circuit 22 between fuel pump 26 and fuel tank 24, downstream from fuel pump 26 and upstream from fuel tank 24. In the exemplary embodiment, fuel system 18 includes a single fuel rail 28 and a single pressure relief valve 30. Fuel pump 26 is operated by a mechanical connection extending from engine body 12, by electrical means, or by other methods. Fuel pump 26 pulls fuel from tank 24 and then forces the fuel under very high pressure, for example 1,000 bar or more, downstream along fuel circuit 22 into one or more fuel rails 28. Fuel rails 28 provide the fuel under pressure to one or more fuel injectors (not shown) by way of feeds 32. Pressure relief valve 30 is positioned along fuel circuit 22 downstream from fuel pump 26 and upstream from fuel tank 24 at any location along fuel circuit 22 that fluidly communicates with fuel rail 28. Thus, pressure relief valve 30 may be positioned in fuel pump 26, fuel rail 28, downstream from fuel rail 28, or in other locations. In the exemplary embodiment, pressure relief valve 30 is positioned along fuel circuit 22 downstream from fuel rail 28 and upstream from fuel tank 24, and fluidly connected to fuel rail 28 at a proximate end of pressure relief valve 30 and to fuel tank 24 at a distal end of pressure relief valve 30. The fuel injectors may be in the form of the injector disclosed in U.S. Pat. No. 5,819,704, the entire content of which is hereby incorporated by reference.

If the fuel pressure in fuel rail 28 exceeds a predetermined amount or level, for example 2,150 bar, then pressure relief valve 30 opens, limiting the amount or level of pressure in fuel rail 28. The fuel that flows through pressure relief valve 30 flows downstream through fuel circuit 22 back to fuel tank 24 or another storage location that is accessible by fuel circuit 22 to feed fuel pump 26. The pressure in fuel rail 28 may exceed the predetermined amount or level for a variety of reasons. For example, the capacity of fuel pump 26 may exceed the ability of the fuel injectors to use fuel under certain conditions, and/or pulsations may be transmitted through fuel rail 28 due to operating conditions within engine 10 that exceed the predetermined amount or level.

Figure 3:
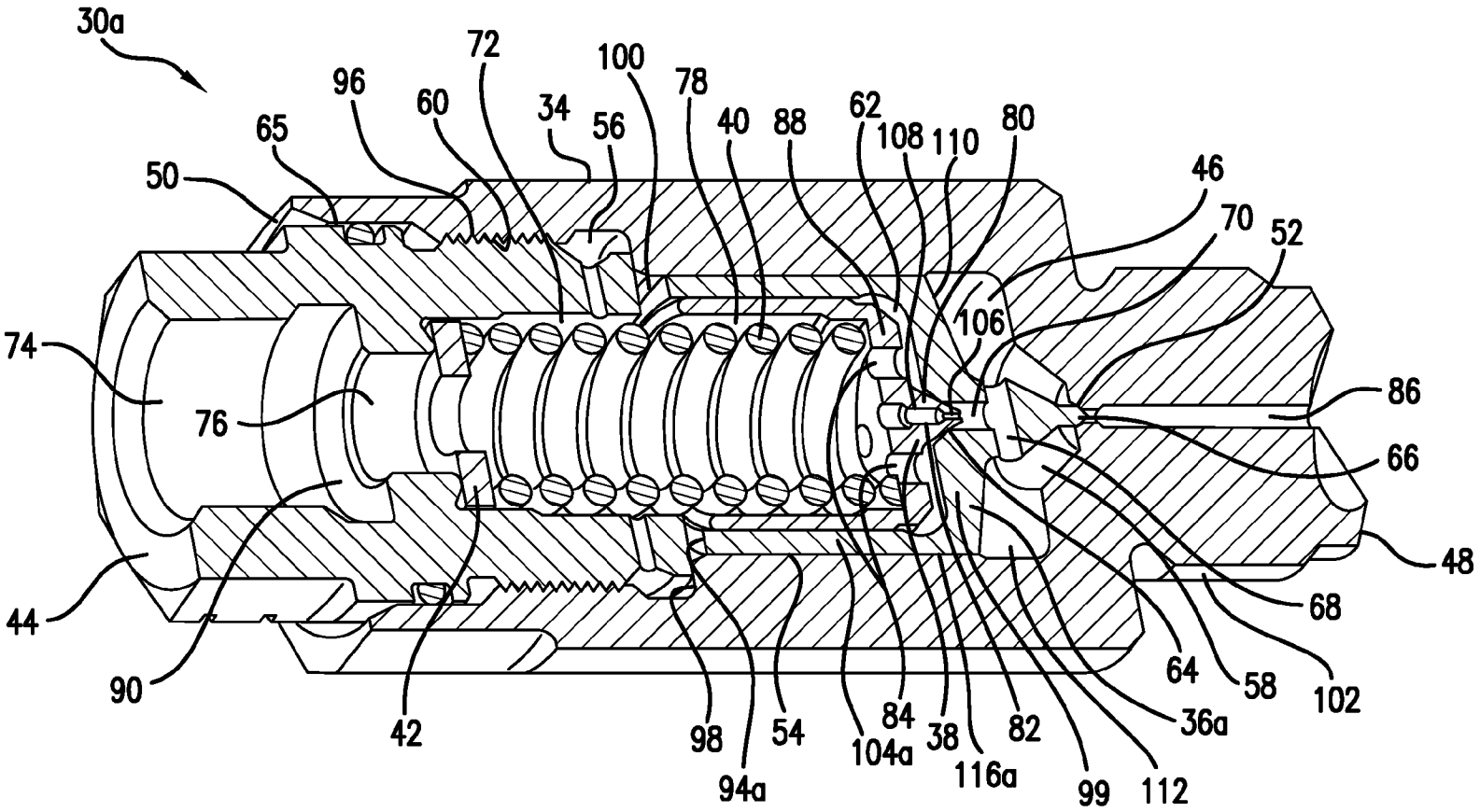
FIG.3 PRIOR ART
FIG. 3 is a perspective sectional view of a conventional fuel pressure relief valve.
Figure 4:
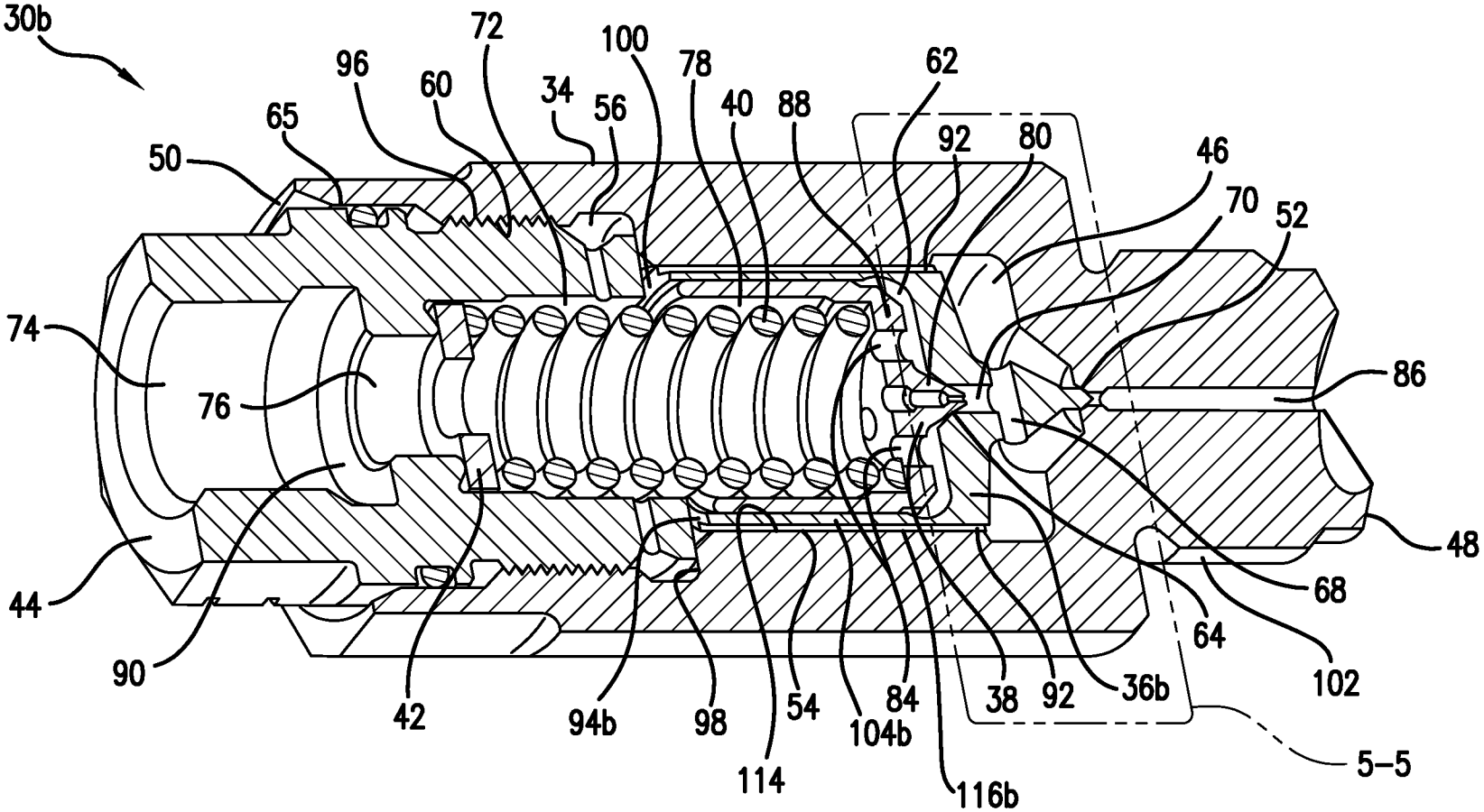
FIG. 4 is a perspective sectional view of a fuel pressure relief valve incorporating an embodiment of the present disclosure.
Figure 5:
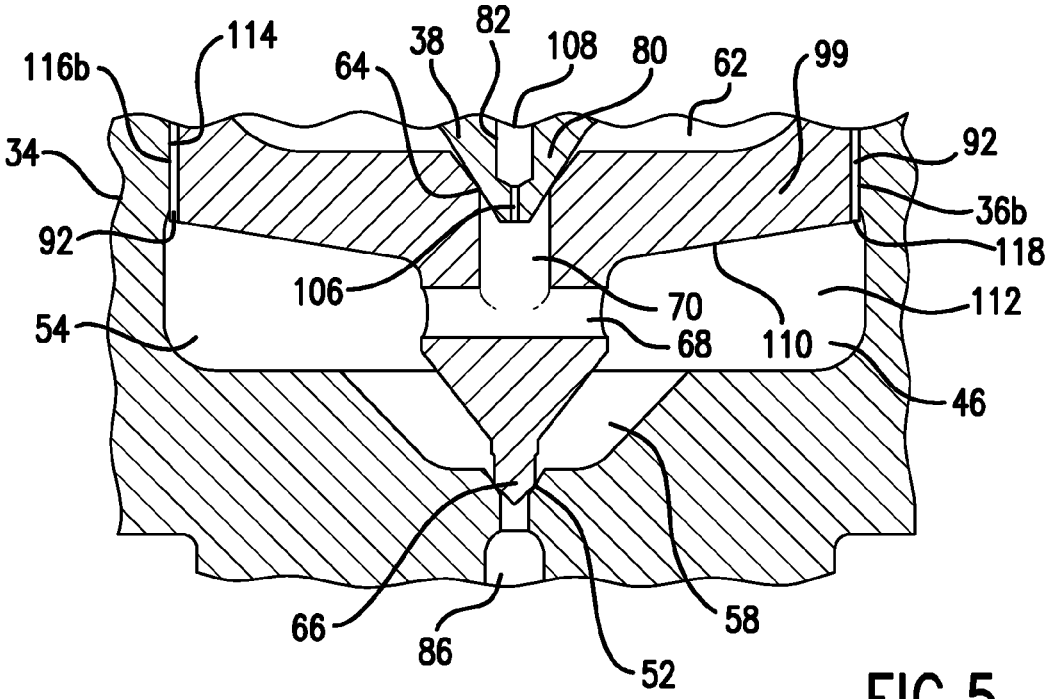
FIG. 5 is a sectional view of a portion of the relief valve of FIG. 4 along the lines 5-5.
Figure 6:
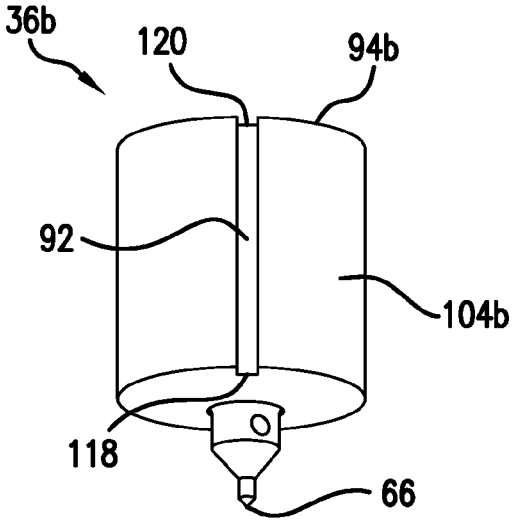
FIG. 6 is a perspective view of a first plunger of the relief valve of FIGS. 4 and 5.
Figure 7:
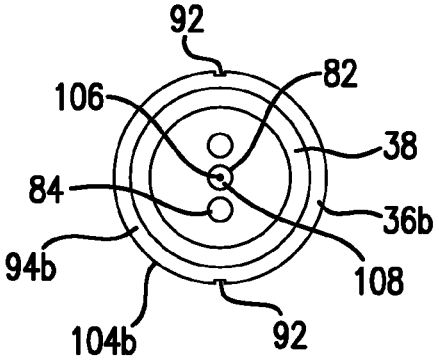
FIG. 7 is a view of a distal end of the first plunger and a second plunger of the relief valve of FIGS. 4 and 5.

A conventional fuel pressure relief valve 30*a* is shown in FIG. 3. Relief valve 30*a* includes a relief valve body 34, a first, lower, or proximate plunger 36*a*, a second, upper or distal plunger 38, a spring 40, a shim 42, and a plug 44.

Valve body 34 includes a first or proximate end 48, a second or distal end 50, an annular interior wall surface 114, a body cavity 46, and a valve body passage 86 connecting body cavity 46 to an exterior of valve body 34; e.g., fuel rail 28. Valve body 34 may be directly connected to fuel rail 28. For example, valve body 34 may include valve body threads 102 that interface with mating threads (not shown) in fuel rail 28. Body cavity 46 includes a proximate or lower cavity portion 54 formed within annular interior wall surface 114, and a distal or upper cavity portion 56. A first plunger seat 52 is formed adjacent to or at a distal end of valve body passage 86 where valve body passage 86 connects to lower cavity portion 54 of body cavity 46. First plunger seat 52 provides a contact surface for first plunger 36*a*. Lower cavity portion 54 is positioned longitudinally between valve body seat 52 and distal end 50. Upper cavity portion 56 is positioned longitudinally between lower cavity portion 54 and distal end 50. Lower cavity portion 54 may include an annular seat cavity portion 58 positioned about first plunger seat 52 and coaxial with first plunger seat 52. Seat cavity portion 58 provides additional clearance about first plunger 36*a* for fuel flowing from fuel rail 28 when relief valve 30*a* opens. Upper cavity portion 56 includes an opening 65 that provides access to body cavity 46 and may include a threaded portion 60.

First plunger 36*a* is positioned for reciprocal, longitudinal, or axial sliding movement within lower cavity portion 54. First plunger 36*a* includes a first plunger barrel 94*a* including a wall portion 104*a* forming a first plunger cavity 62, a second plunger seat 64, a first valve surface 66, and a first relief passage that may include a transverse flow passage 68 and a longitudinal flow relief passage 70. First plunger cavity 62 is open at a distal end of first plunger 36*a*. Wall portion 104*a* of first plunger 36*a* includes an exterior surface a that is sized and dimensioned to slidingly and sealingly engage interior wall surface 114 of valve body 34 to create a sliding interface. In this context, "sealingly" means substantially sealed in that fuel is unable to freely flow between exterior surface 116*a* and interior wall surface 114, i.e., a substantial fluid seal.

First valve surface 66 is located at a proximate end of first plunger 36*a*. When first plunger 36*a* is in a closed position, first valve surface 66 contacts or abuts first plunger seat 52 to form a plunger-seat interface. When first plunger 36*a* opens, first valve surface 66 moves longitudinally away from first plunger seat 52, permitting fuel to flow into body cavity 46 from valve body passage 86. Transverse flow passage 68 is positioned between first valve surface 66 and first plunger cavity 62. Longitudinal flow passage 70 extends axially between and fluidly connects transverse flow passage 68 and first plunger cavity 62. Second plunger seat 64 is formed at a distal end of longitudinal flow passage 70 where longitudinal flow passage 70 connects to first plunger cavity 62. A first plunger wall 99 is positioned at a proximate end of first plunger cavity 62, extending radially from longitudinal flow passage 70 to wall portion 104*a*. First plunger wall 99 includes an exterior surface 110. When first plunger 36*a* is in the closed position, a fuel chamber or volume 112 exists between an exterior surface 110 and relief valve body 34. Thus, fuel chamber 112 is formed in proximate cavity portion 54 of body cavity 46.

Plug 44 is positioned within upper cavity portion 56. Plug 44 includes a first cavity 72 positioned at a proximate end of plug 44, a second cavity 74 positioned at a distal end of plug 44, and a longitudinally extending plug passage 76 formed in a plug wall 90 to fluidly connect first cavity 72 to second cavity 74. First cavity 72, plug passage 76 and second cavity 74 permit fuel flowing through pressure relief valve 30*a* to flow downstream through fuel circuit 22 to fuel tank 24. Plug 44 may include an externally threaded portion 96 for engaging threaded portion 60 of valve body 34.

Second plunger 38 is positioned for reciprocal movement within first plunger cavity 62. Second plunger 38 includes a second plunger cavity 78, a second valve surface 80, a leakage passage 82, one or more main passages 84, and a second plunger wall 88. Second valve surface 80 is at a proximate end of second plunger 38 and when second plunger 38 is in a closed position second valve surface 80 abuts second plunger seat 64. Leakage passage 82 includes a passage first portion 106 having a first diameter that extends from the proximate end of second valve surface 80 and a passage second portion 108 having a second, larger diameter that extends from passage first portion 106 to second plunger cavity 78, thereby fluidly connecting longitudinal flow passage 70 to second plunger cavity 78. Second plunger wall 88 extends transversely to the longitudinal extent of pressure relief valve 30*a* in a location between second valve surface 80 and second plunger cavity 78. Main passages 84 extend longitudinally or axially through second plunger wall 88 to provide fluid communication between first plunger cavity 62 and second plunger cavity 78. Second plunger cavity 78 is open at a distal end of second plunger 38.

Spring 40 extends longitudinally between second plunger wall 88 and plug wall 90. Spring 40 is positioned partially within second plunger cavity 78 and partially within plug first cavity 72. Shim 42 is positioned in plug first cavity 72 between a distal end of spring 40 and plug wall 90. Spring 40 is in contact with second plunger wall 88 and shim 42. Shim 42 permits relative motion between spring 40 and provides a hardened surface to contact spring 40.

Assembly of components into pressure relief valve 30*a* is through opening 65 formed in the distal end of relief valve body 34. Pressure relief valve 30*a* may be assembled by first positioning first plunger 36*a* within lower cavity portion 54 so that first valve surface 66 is in contact or an abutting relationship with valve body seat 52. Next, second plunger 38 is positioned within first plunger cavity 62 so that second valve surface 66 is in contact or an abutting relationship with second plunger seat 64. Spring 40 is then positioned within second plunger cavity 78 in contact with second plunger wall 88. Shim 42 is placed at the end of spring 40 and then plug 44 is secured in upper cavity portion 56 of relief valve body 34 to retain first plunger 36*a*, second plunger 38, spring 40, and shim 42. In the exemplary embodiment, plug 44 includes externally threaded portion 96 that engage mating threads 60 formed in relief valve body 34. Plug 44 may be positioned against a step 98 formed in relief valve body 34, which then causes a predetermined compression of spring 40.

The assembly of first plunger 36 into proximate cavity 54, second plunger into first plunger cavity 62, spring 40 into second plunger cavity 78, and the attachment of plug 44 to capture first plunger 36, second plunger 78, spring 40 and shim 42, causes a longitudinal separation between a proximate end of plug 44 and a distal end of first plunger 36*a*. The longitudinal separation forms a longitudinal gap 100. Longitudinal gap 100 may be in the shape of an annulus and extend the circumference of plug 44, and first plunger 36*a*.

As described hereinabove, pressure relief valve 30*a* functions to relieve pressure above a predetermined level from fuel rail 28 in a mode of operation that may be described as a main or primary mode of operation. The primary mode of operation is accomplished through a main or primary relief circuit, which includes transverse passage 68, longitudinal passage 70, second plunger seat 64, first plunger cavity 62, main passages 84 formed in second plunger 38, and second plunger cavity 78. This circuit is capable of handling a relatively high volume of fuel flow necessary to provide pressure relief of fuel rail 28. The predetermined pressure level is established by the characteristics of spring 40 and the amount of compression on spring 40. Fuel pressure above the predetermined level moves first plunger 36*a* longitudinally within proximate cavity portion 54, causing first valve surface 66 of first plunger 36*a* to move away from valve body seat 52. The distal end of first plunger 36*a* moves into contact with plug 44, forming a substantial fluid seal with plug 44 and closing longitudinal gap 100. Fuel flows into fuel chamber 112 of lower cavity portion 54 of body cavity 46. The fuel then enters the main or primary relief circuit, flowing transversely toward a longitudinal axis of pressure relief valve 30*a* into transverse flow passage 68. The fuel then flows axially into longitudinal flow passage 70. The pressure of the fuel then moves second plunger 38 longitudinally, causing second valve surface 80 to move away from second plunger seat 64. Fuel is then able to flow into first plunger cavity 62 and then longitudinally through main passages 84 of second plunger 38 into second plunger cavity 78. The fuel then moves from the main or primary relief circuit into first cavity 72. From first cavity 72, the fuel flows through plug passage 76 into second cavity 74, which is in fluid communication with fuel reservoir or tank 24.

Pressure from fuel rail 28 may lift first plunger 36*a* without lifting second plunger 38, or second plunger 38 may seat against second plunger seat 64 before first plunger 36*a* seats against first plunger seat 52. The fuel remaining in fuel chamber 112 remains under pressure, slowing or preventing first plunger 36*a* from moving longitudinally toward first plunger seat 52. Leakage passage 82 provides a path for fuel to flow from fuel chamber 112, reducing pressure in fuel chamber 112 and permitting first plunger 36*a* to move longitudinally to first plunger seat 52. Thus, leakage passage 82 functions to prevent first plunger 36*a* from being locked in an open position should second plunger 38 seat prior to the first plunger 36*a* seating.

While fuel pressure relief valve 30*a* functions well for its intended purpose, it is also susceptible to conditions that cause leakage into fuel chamber 112. For example, axial or lateral movement of first plunger 36*a* may permit leakage past first plunger seat 52. In another example, first plunger 36*a* may be subject to pulsations from the operation of engine 10. The pulsations, which may be caused by opening and closing of fuel injectors (not shown), operation of fuel pump 26 and/or other sources, cause small axial or lateral movements of first plunger 36*a*, permitting fuel to leak past the plunger-seat interface between first valve surface 66 and valve body seat 52 and causing pressure to build or accumulate in lower cavity portion 54. Because of the rate of accumulation or the amount of leakage past first plunger seat 52, sufficient pressure is able to build in fuel chamber 112 of lower cavity portion 54 to cause first plunger 36*a* and second plunger 38 to open or lift off their seats undesirably. Because the opening of first plunger 36*a* and second plunger 38 can occur frequently during operation of engine 10, the components of fuel pressure relief valve 30*a* wear because of the constant, undesirable movement.

Applicants recognized that the leakage past first plunger seat 52 into fuel chamber 112 causes undesirable operational conditions for an associated fuel circuit. Accordingly, a fuel pressure relief valve 30*b* in accordance with an exemplary embodiment of the present disclosure and shown in FIGS. 4-7 provides an improved configuration that relieves the leakage into fuel chamber 112 of lower cavity portion 54. To reduce or eliminate the undesirable opening of the fuel pressure relief valve in the presence of the aforementioned leakage, fuel pressure relief valve 30*b* includes a second mode of operation that may be described as an auxiliary, or secondary mode of operation the relieves fuel pressure from fuel chamber 112 that is below a predetermined level. Fuel pressure relief valve 30*b* is similar to pressure relief valve 30*a* and includes components that are similar to pressure relief valve 30*a*. However, fuel pressure relief valve 30*b* includes a first plunger 36*b*. First plunger 36*b* includes a first plunger barrel 94*b* that includes a wall portion 104*b*. Wall portion 104*b* includes an exterior surface 116*b*.

A sliding interface between exterior surface 116*b* of first plunger wall portion 104*b* of first plunger 36*b* and interior wall surface 114 of lower cavity portion 54 of body cavity 46 includes a secondary or leakage relief passage 92. In the exemplary embodiment, first plunger 36*b* includes at least one secondary relief passage 92 that extends the length of first plunger barrel 94*b* along first plunger wall portion 104*b*. Secondary relief passage 92 may be a groove formed in wall portion 104*b*, which in the exemplary embodiment may be a longitudinal groove. Secondary relief passage 92 is sized and dimensioned to permit a small volume of fuel to flow therethrough under high pressure, such as might occur from leakage between first valve surface 66 and first plunger seat 52, but is incapable of providing the high volume of fuel flow that occurs when fuel pressure relief valve 30*b* opens due to a high-pressure event in fuel rail 28. Because of the volume of fuel that is able to flow into chamber 112 when first plunger 36*b* fully opens, and because of the rapidity of movement of first plunger 36*b* against plug 44 to block secondary relief passage 92, the maximum size of secondary relief passage 92 is limited by the thickness of wall portion 104*b* rather than consideration of fluid flow through secondary relief passage 92. Secondary relief passage 92 includes a passage first end 118 that opens into proximate cavity portion 54 and a passage second end 120 that opens into proximate cavity portion 54 at the opposite end of secondary relief passage 92 from first end 118.

The auxiliary mode of operation is accomplished through an auxiliary or secondary relief circuit, which includes secondary relief passage 92 and longitudinal gap 100. The secondary relief circuit is fluidly in parallel to the main or primary relief circuit described hereinabove. The configuration of the auxiliary relief circuit permits a small volume of fuel to flow from fuel chamber 112 downstream to fuel tank 24. The volume of fuel flow is defined by the size and dimension of the fluid passages of the auxiliary relief circuit, particularly the size and dimensions of secondary relief passage 92, described hereinabove. The auxiliary circuit is incapable of handling a high volume of fuel flow because the auxiliary circuit needs to maintain a high-pressure drop to high volume fuel flow to permit the primary or main relief circuit to operate. The addition of one or more secondary relief passages 92 along the exterior of first plunger barrel 94*b* eliminates the buildup of fuel pressure between first plunger 36*b* and relief valve body 34 due to fuel leakage between first valve surface 66 and first plunger seat 52. Fuel is able to flow through the auxiliary relief circuit by entering passage first end 118 and flowing through secondary relief passage 92 from the proximate end of first plunger 36*b* to the distal end of first plunger 36*b*. At the distal end of first plunger 36*b*, fuel flows through passage second end 120 into longitudinal gap 100. This fuel then flows transversely through longitudinal gap 100 between the distal end of first plunger 36*b* and the proximate end of plug 44, exiting the auxiliary relief circuit. This fuel leakage then flows through first cavity 72, plug passage 76 and second cavity 74 to return to fuel tank or reservoir 24.

As can be seen, there are functional differences between the operation of the main or primary relief circuit and the secondary or auxiliary relief circuit. The operation of the main or primary relief circuit is controlled by spring 40. In contrast, the secondary or auxiliary relief circuit is passive and serves only to provide a defined leakage path in parallel to the main or primary circuit. When the main or primary circuit opens, first plunger 36*b* moves relative to first plunger seat 52, and second plunger 38 moves relative to second plunger seat 64. This movement is possible because in the first mode of operation caused by, for example, a high pressure relief event, first plunger 36*b* moves far enough from first plunger seat 52 and opens long enough for pressure to build in fuel chamber 112 to a sufficient pressure level to lift second plunger 38 off its seat 64. In contrast, during the second mode of operation caused by fuel leakage into fuel chamber 112, only first plunger 36*b* moves and the secondary or auxiliary relief circuit operates to effectively relieve the undesirable pressure buildup in fuel chamber 112. That is, first plunger 36*b* only moves a small amount from first plunger seat 52 in the second mode of operation, and only for a relatively short time, thus preventing pressure from building in fuel chamber 112 that would be sufficient to cause movement of second plunger 38 from its seat 64. The function of the main or primary relief circuit is to provide a fuel path for the volume of fuel necessary to relieve or reduce pressure in fuel rail 28. In contrast, the function of the secondary or auxiliary relief circuit is to provide a fuel path for pressurized fuel in fuel chamber 112 due to undesirable leakage through the first valve surface 66 and first plunger seat 52. Thus the main relief circuit functions to relieve fuel intentionally or desirably delivered to fuel chamber 112 to relieve fuel rail 28 to prevent over pressurization of rail 28, and the auxiliary relief circuit operates to relieve fuel undesirably delivered to fuel chamber 112 due to, for example, operational characteristics of the system.

At least one secondary relief passage 92 is necessary to prevent undesired buildup of pressure in fuel chamber 112. More secondary relief passages 92 may be used. If more secondary relief passages 92 are used, secondary relief passages 92 should be angularly spaced about first plunger barrel 94*b* at equal angles to maintain a load balance on first plunger barrel 94*b*. The exemplary embodiment includes two longitudinally extending secondary relief passages 92 positioned 180 degrees apart.

Secondary relief passage or passages 92 are sized and dimensioned with an appropriate total cross sectional flow area large enough to provide sufficient fuel flow during the second mode of operation while small enough to create the requisite pressure drop across passages 92 to ensure proper operation of the main relief circuit, and in particular the lifting of second plunger 64, during the first mode of operation. That is, secondary relief passages 92 provide a balance between two performance factors that permit fuel pressure relief valve 30*b* to function properly. The cross sectional flow area of secondary relief passages 92 create a relatively high-pressure drop to fuel flow when pressure relief valve 30*b* opens in the presence of fuel pressure in fuel rail 28 above the predetermined level. This high pressure drop thus permits a buildup of pressure in fuel chamber 112 when a relatively high volume of fuel flow at a pressure above the predetermined level is present, causing first plunger 36*b* and second plunger 38 to open. Conversely, if secondary relief passage 92 is too large, pressure buildup in fuel chamber 112 will be intermittent or erratic, causing first plunger 36*b* and second plunger 38 to open and close rapidly, leading to undesirable pressure fluctuations in fuel rail 28. In the present embodiment, the thickness of wall portion 104*b* of first plunger 36*b* provides a limit to the maximum cross-sectional flow area of secondary relief passage 92. The flow area of the first relief passage is sufficiently larger than the size of secondary relief passages 92 that pressure desirably builds in chamber 112 to relieve an overpressure event in fuel rail 28.

When the volume of fluid flowing into fuel chamber 112 overcomes the ability of secondary relief passage 92 to drain fuel from fuel chamber 112, such as occurs during an overpressure event in fuel rail 28, pressure will build in fuel chamber 112, as described hereinabove. Once the pressure increases above a predetermined pressure level determined by the size of first plunger 36 and spring 40, first plunger 36*b* will move longitudinally away from first plunger seat 52 into an open position. First plunger 36*b* will seat against plug 44, forming a substantial fluid seal with plug 44 and closing or blocking flow through longitudinal gap 100. The movement of first plunger 36*b* into the open position will then cause second plunger 38 to open, permitting flow through the primary relief circuit. Because first plunger 36 is in contact with plug 44, the second or auxiliary relief circuit is closed to fuel flow when the primary relief circuit is open to fuel flow.

When only low volume leakage is present, secondary relief passage 92 provides adequate flow of fuel to prevent first plunger 36*b* and/or second plunger 38 from opening fully. Enlarging leakage passage 82 does not achieve these goals. Increasing the diameter of leakage passage 82 decreases buildup of pressure in fuel chamber 112 at low volume flow or leakage into fuel chamber 112, but the increase in diameter also undesirably increases the pressure required to actuate relief valve 30*b*, specifically the pressure required to lift second plunger 38 off second plunger seat 64. Furthermore, the flow through an enlarged leakage passage 82 would undesirably decrease fuel rail pressure when first plunger 36 opens, which undesirably affects the performance of fuel circuit 22. Thus, the addition of one or move secondary relief passages 92 that are closed when the primary relief circuit opens eliminates undesirable buildup of pressure in fuel chamber 112, while permitting fuel pressure relief valve 30*b* to open relieve pressure to fuel tank 24 when fuel pressure in fuel rail 28 exceeds the predetermined value.

While the exemplary embodiment shows the use of first plunger 36*b* and second plunger 38, a single plunger may provide acceptable operating performance in another embodiment. A single plunger fuel pressure relief valve may also incorporate a primary relief circuit with fluid flow through the single plunger and an auxiliary or secondary relief circuit that includes a relief passage along a plunger/valve body interface. Thus, the present disclosure anticipates that other relief valve configurations having a main or primary flow circuit may benefit from the addition of the auxiliary or secondary relief circuit described herein.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We claim:

1. An internal combustion engine, comprising:

a fuel circuit;

a fuel tank positioned along the fuel circuit;

a fuel pump positioned along the fuel circuit downstream of the fuel tank;

a fuel pressure relief valve in fluid communication with the fuel pump and the fuel tank, the fuel pressure relief valve including a valve body, a valve body passage formed in the valve body, a valve body cavity, a first plunger seat positioned in the valve body cavity adjacent the valve body passage, a first plunger reciprocally mounted in the valve body cavity to form a sliding fluid seal interface with the valve body, a fuel chamber positioned in the valve body cavity between the first plunger and the valve body, a primary relief circuit positioned to permit fuel flow from the fuel chamber, and an auxiliary relief circuit positioned fluidly in parallel to the primary relief circuit to permit fuel to flow from the fuel chamber toward the fuel tank when the pressure in the fuel chamber is below a predetermined pressure level, the auxiliary relief circuit including a relief passage located along the sliding fluid seal interface, the first plunger including a first plunger cavity, the first plunger adapted to reciprocate between a closed position in abutment against the first plunger seat to block fuel flow through the valve body passage and an open position a spaced distance from the first plunger seat permitting flow through the valve body passage into the fuel chamber.

2. The internal combustion engine of claim 1, the first plunger including a second plunger seat and the fuel pressure relief valve further including a second plunger slidingly positioned in the first plunger cavity along the primary relief circuit downstream from the first plunger and adapted to move from a closed position in abutment against the second plunger seat to block fuel flow from the fuel chamber to an open position when the pressure in the fuel chamber is above the predetermined pressure level.

3. The internal combustion engine of claim 2, the primary relief circuit further including a longitudinal flow passage fluidly connected to the first plunger cavity, wherein the second plunger seat is formed at a distal end of the longitudinal flow passage.

4. The internal combustion engine of claim 3, the fuel pressure relief valve further including a valve plug engaged to a distal end of the valve body, the second plunger including a second plunger cavity, and a spring positioned between the valve plug and the second plunger and at least partially located within the second plunger cavity.

5. The internal combustion engine of claim 1, the primary relief circuit including a transverse flow passage and a longitudinal flow passage, the transverse flow passage positioned between a proximate end of the first plunger and the first plunger cavity, and the longitudinal flow passage extending from the transverse flow passage to the first plunger cavity.

6. The internal combustion engine of claim 5, wherein the second plunger seat is formed at a distal end of the longitudinal flow passage.

7. The internal combustion engine of claim 1, the first plunger including a plunger barrel forming the first plunger cavity and the relief passage including a longitudinal passage formed in the plunger barrel.

8. The internal combustion engine of claim 1, the relief passage extending the entire length of the sliding fluid seal interface.

9. The internal combustion engine of claim 1, further including a valve plug engaged to a distal end of the valve body, wherein a longitudinal gap is formed between a distal end of the first plunger and a proximate end of the valve plug, and the longitudinal gap is positioned along the auxiliary relief circuit downstream from the relief passage.

10. The internal combustion engine of claim 8, wherein the relief passage opens at a first end at the fuel chamber and opens at a second end at the longitudinal gap.

11. The internal combustion engine of claim 1, wherein at least two relief passages are located along the sliding fluid seal interface.

12. A pressure relief valve for an internal combustion engine including a fuel circuit, a fuel tank positioned along the fuel circuit, a fuel pump positioned along the fuel circuit downstream of the fuel tank, and a fuel rail positioned along the fuel circuit to receive fuel from the fuel pump, the pressure relief valve comprising:

a valve body;

a first plunger positioned in the valve body along a sliding interface to form a fuel chamber and including a first plunger cavity;

a primary relief circuit, the first plunger positioned along the primary relief circuit; and an auxiliary relief circuit positioned fluidly in parallel to the primary relief circuit, the auxiliary relief circuit including a relief passage located along the sliding interface to permit fuel to flow from the fuel chamber to the fuel tank when the pressure in the fuel chamber is below a predetermined pressure level, and the primary relief circuit positioned to permit fuel flow from the fuel chamber to the fuel tank when the pressure in the fuel chamber is above the predetermined pressure level.

13. The pressure relief valve of claim 12, the pressure relief valve further including a second plunger slidingly positioned in the first plunger cavity and the second plunger positioned along the primary relief circuit downstream of the first plunger.

14. The pressure relief valve of claim 13, the primary relief circuit including a longitudinal passage positioned between a proximate end of the first plunger and the first plunger cavity and a second plunger seat formed at a distal end of the longitudinal passage, the second plunger having a second valve surface and a second plunger cavity, the second plunger positioned in the first plunger cavity such that the second valve surface abuts the second plunger seat.

15. The pressure relief valve of claim 13, further including a valve plug engaged to a distal end of the valve body, and a spring positioned between the valve plug and the second plunger and at least partially located within the second plunger cavity.

16. The pressure relief valve of claim 15, the valve plug including a first cavity, a plug passage, and a second cavity, and fuel flow through the fuel pressure relief valve to the fuel tank flows through the first cavity, the plug passage and the second cavity.

17. The pressure relief valve of claim 12, the primary relief circuit including a transverse flow passage, the transverse flow passage positioned between the longitudinal passage and a proximate end of the first plunger.

18. The pressure relief valve of claim 12, the first plunger including a plunger barrel forming the first plunger cavity and the relief passage including a longitudinal passage formed in the plunger barrel.

19. The pressure relief valve of claim 12, the relief passage extending the entire length of the interface.

20. The pressure relief valve of claim 12, further including a valve plug engaged to a distal end of the valve body, and a longitudinal gap is formed between a distal end of the first plunger and a proximate end of the valve plug, the longitudinal gap being positioned along the auxiliary relief circuit downstream from the relief passage.

21. The pressure relief valve of claim 20, wherein the relief passage opens at a first end at the fuel chamber and opens at a second end at the longitudinal gap.

22. The pressure relief valve of claim 12, wherein at least two relief passages are located in the sliding interface.

* * * * *